US006537048B2

(12) United States Patent
Rost et al.

(10) Patent No.: US 6,537,048 B2
(45) Date of Patent: Mar. 25, 2003

(54) PUMP BODY FOR A MEDICAL GEAR PUMP

(75) Inventors: Axel Rost, Gottmadingen (DE); Rudolf Henes, Schaffhausen (CH)

(73) Assignee: Storz Endoskop GmbH (CH)

( * ) Notice: Subject to any disclaimer, the term of this patent is extended or adjusted under 35 U.S.C. 154(b) by 0 days.

(21) Appl. No.: 09/935,106

(22) Filed: Aug. 22, 2001

(65) Prior Publication Data

US 2002/0021979 A1 Feb. 21, 2002

Related U.S. Application Data

(63) Continuation of application No. PCT/EP00/12633, filed on Dec. 13, 2000.

(30) Foreign Application Priority Data

Dec. 23, 1999 (DE) ..... 199 62 498

(51) Int. Cl.[7] ..... F04C 2/16

(52) U.S. Cl. ..... 418/201.1; 418/206.1; 418/206.7

(58) Field of Search ..... 418/70, 201.1, 418/206.1, 206.7, 206.9

(56) References Cited

U.S. PATENT DOCUMENTS

| | | | | |
|---|---|---|---|---|
| 2,869,473 A | | 1/1959 | Kreamer | 418/189 |
| 3,105,446 A | * | 10/1963 | Blomgren, Sr. et al. | 418/206.1 |
| 4,111,614 A | * | 9/1978 | Martin et al. | 418/206.1 |

FOREIGN PATENT DOCUMENTS

| | | |
|---|---|---|
| DE | 460 962 | 6/1928 |
| DE | 83 15 309.8 | 10/1984 |
| DE | 196 27 405 | 1/1998 |
| DE | 197 25 462 | 12/1998 |
| DE | 199 62 498 | 7/2001 |
| FR | 1 308 375 | 9/1962 |

* cited by examiner

*Primary Examiner*—John J. Vrablik
(74) *Attorney, Agent, or Firm*—St. Onge Steward Johnston & Reens LLC

(57) ABSTRACT

A pump body for a medical gear pump for sucking and irrigating has a pot-like pump housing with two cylindrical openings, in which two meshing gearwheels are embedded. The driving gearwheel is, without pivot bearing, embedded in the opening. A lid is used for closing the pot-like pump housing. A trunnion protrudes from a bottom of the pump housing, onto which trunnion the driven gearwheel is mounted.

4 Claims, 1 Drawing Sheet

PUMP BODY FOR A MEDICAL GEAR PUMP

CROSSREFERENCE OF PENDING APPLICATION

This application is a continuation of pending international application PCT/EP00/12633 filed on Dec. 13, 2000 and designating US.

BACKGROUND OF THE INVENTION

The present invention relates to a pump body for a medical gear pump for sucking and irrigating, with a pot-like pump housing with two cylindrical openings overlapping one to another, in which openings two meshing gearwheels are arranged, namely a driving gearwheel and a driven gearwheel. The driving gearwheel is, without a pivot bearing, arranged in the corresponding opening. Each opening is connected to an inlet and to an outlet. A lid is provided for closing the pot-like pump housing.

Such a pump body for a medical gear pump is known from DE 197 25 462 A1.

In the medical gear pump for sucking and irrigating described, both gearwheels meshing with each other via a spiral gearing, are embedded without pivot bearing in the openings of the pump body. The pot-like pump body is closed via a lid being trespassed by a coupling pin of the driving gearwheel. Each opening is in connection with an inlet connection piece and an outlet connection piece, which, in that way, form an inlet and an outlet of the medical gear pump.

The assembly of pump housing, lid and the meshing gearwheels embedded therein form a compact pump body, which is connectable with a drive body via a bayonet connection, in such a way that the coupling pin protruding from the driving gearwheel engages into a corresponding coupling slit of the drive body.

In order to clean the medical gear pump, the pump body is unlocked by the drive body via the bayonet connection, the lid is taken off, so that both gearwheels can be pulled out of the openings of the pump body.

After being cleaned and sterilized, both gearwheels can be pushed back, the lid can be applied and the pump body being assembled in such a way can be put on to the drive body again.

To avoid bacteria niches and to facilitate cleaning, this medical gear pump does not contain trunnion bearings for the two gearwheels in the openings.

When the gearwheels are taken off from the pump housing, the inner part of the pump housing contains merely the cylindrical openings, which can easily be cleaned and sterilized.

It was experienced in practical use that the driven gearwheel, i.e. the gearwheel which is not directly driven is pressed against the inner wall of the pump housing not only by the difference pressure between inlet and outlet, but also by the drive of the driving gearwheel during operation. When the flow resistance is high, this fact may result in high wear by abrasion, if the material the driven gearwheel is made of is not selected for optimal gliding conditions or if the fittings of the gearwheels to the housing bores are not precisely performed. Permanent operation, with a high load, results in a relatively strong generation of heat within the pump housing. Consequently, a relatively higher torque is required to create high feed pressures. This increased torque, however, requires stronger coupling pins and drive pins of the driving gearwheel. In order to prevent that, the coupling pin may be equipped with a relatively high diameter, which results, however, in a relatively high wear at the shaft seal as a consequence of an increased circumferential speed. The coupling pin protruding from the pump body has to pass the bottom of the pump body surrounded by a seal.

If the gear pump is intended to be used in multiple or permanent operation, the material of the housing and the gearwheels turning within needs to match in an optimum manner which requires hard materials with very good sliding properties.

This requires high quality materials and precisely manufactured components.

It is, therefore, an object of the present invention to manufacture a pump body, which shows good pump performances, but is cost-saving.

SUMMARY OF THE INVENTION

This object is achieved by a trunnion protruding from the bottom of the pump housing onto which trunnion the driven gearwheel is pushed onto.

The driven gearwheel is guided by the trunnion. The driven gearwheel, except within predetermined tolerances, is not extensively pressed against the inner wall of the pump housing by the driving gearwheel.

Thus, it is not necessary to use particularly wear-resistant materials, which were precisely manufactured. The materials used are cost-saving materials. The same applies for the material of the pump housing.

Pressure force peaks acting from the wall of the housing openings onto the curved lines of the soft elastic tooth tips of the driven gearwheel are taken up by the trunnion. The tooth tips of the driven gearwheel are more charged than the respective tips of the driving gearwheel. The pressure force peaks taken up by the trunnion are forces in the range of the elastic deformability of the material the teeth are made.

Material abrasion at the driven gearwheel is thus prevented. A possible wobbling of the gearwheels within the clearance of the overlapping openings is strongly reduced.

This design is useful to make a single use pump body. The requirements of the materials are merely that one single use is safely ensured. This offers the possibility to use cheap injection molding materials with relatively large clearances to produce pump housings as well as gearwheels.

A simple handling and a simple mounting of the pump is possible, as the trunnion serves as orientation feature and centering aid for the driven gearwheel while mounting.

After using of the pump, the pump body can be turned off the drive body via the bayonet connection and can be disposed, and for the next use of the pump a new pump body can be mounted.

In a preferred embodiment of the invention, the trunnion is molded to the bottom of the pump housing.

This measurement has the advantage that the bearing trunnion is simultaneously molded or injected to the bottom of the pump housing when the pump housing is manufactured so that it is possible to manufacture the pump housing in a particular simple and cost-saving way.

In a further embodiment of the invention, the trunnion is slightly conical.

This measurement has the advantage in view of manufacturing that a conical trunnion can be much more easily removed from an injection tool than a cylindrical trunnion. Due to the conical shape it is also easy to center the gearwheel while mounting and in operation.

Both the driving gearwheel and the driven gearwheel can be manufactured as simple injection molded parts which are mounted into the pump housing, which is also designed as a injection molded part, and the pump housing then closed via the lid. All of these parts can be manufactured with less technical effort and cheaply. Therefore, a pump body is available for one single use, which, nevertheless, allows relatively strong drive forces with a safe and sufficient pump performance.

It is understood that the afore-mentioned features and the features to be explained later cannot only be used in the combinations mentioned, but can also be used in other combinations or solely without leaving the scope of the present invention.

BRIEF DESCRIPTION OF THE DRAWINGS

The invention is now further described and explained with the help of a preferred embodiment in connection with the enclosed drawings, in which.

Figure 1:
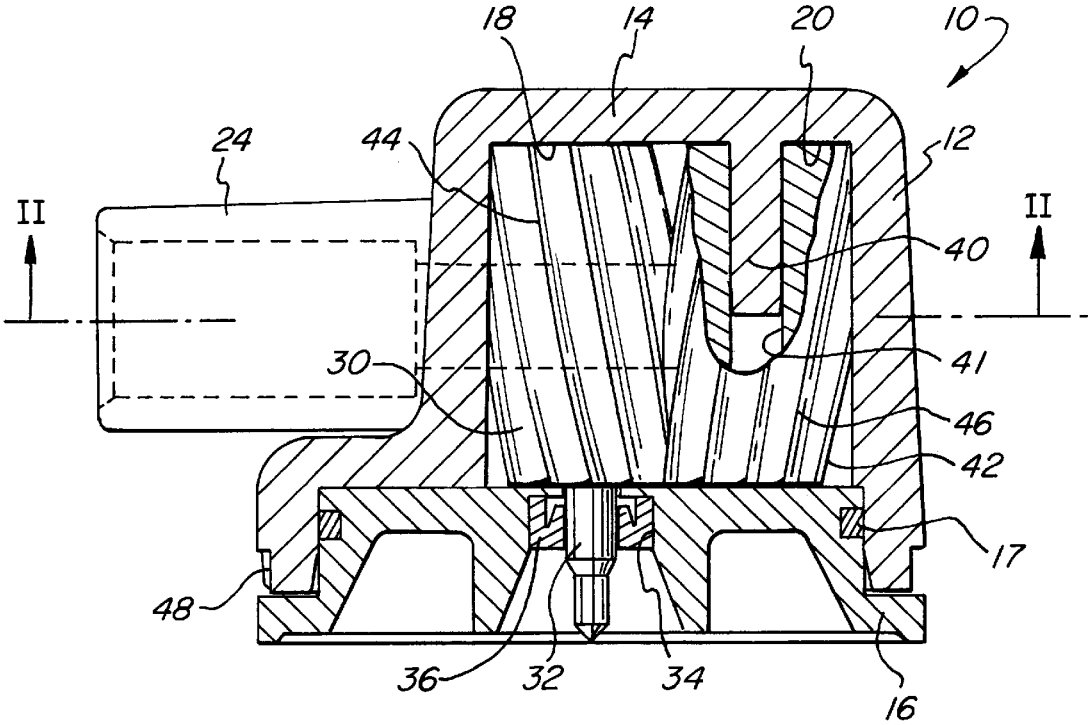
FIG. 1 shows a longitudinal section through a pump body along a plane in which the rotational axis of the gearwheels lies.
Figure 2:
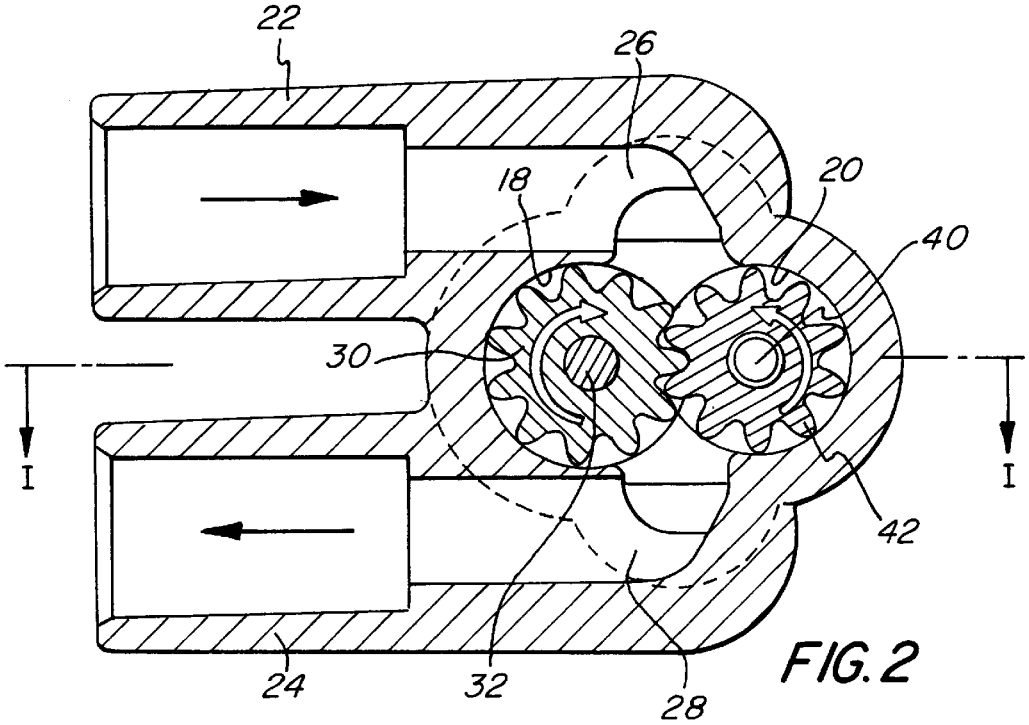
FIG. 2 shows a cross section along the line II—II of FIG. 1.

A pump body shown in FIGS. 1 and 2 is designed in its entire with reference number 10.

The pump body 10 has a pot-like pump housing 12, which is closed at its bottom end via a one-part bottom 14 connected with it. The pump housing is designed as a plastic injection part, i.e. of the material PC Macrolon, as it is offered by the firm Bayer, Germany.

The pot-like pump housing 12 can be closed at its open side via a lid 16. A seal 17 leading circumferentially around the lid 16 seals the inner space of the pump housing 12.

In the pump housing 12, two cylindrical openings 18 and 20 overlapping each other are recessed.

The openings 18 and 20 are, on the one hand, connected to an inlet connection piece 22, which protrudes on the side of the pump housing 12. On the other side, the openings 18 and 20 are connected to an outlet connection piece 24, which also protrudes on this side and extends on the same level and parallel to the inlet connection piece 22.

In such a way, an inlet 26 is created, via which a liquid can be sucked into the pump housing 12. Correspondingly, an outlet 28 is created, via which the liquid may be discharged.

A gearwheel 30 is arranged within first opening 18. A coupling pin 32 protrudes axially from the gearwheel 30 on a side facing the lid 16.

The coupling pin 32 extends through an opening 34 in the lid 16 and protrudes from it. A seal 36 surrounds the coupling pin 32, providing a close seal to the inner side of the pump housing.

The gearwheel 30 is thus the driving gearwheel.

As can be seen from FIG. 1, a trunnion 40 protrudes from the inner side of the bottom 14, which has a slightly conical shape and which is directly injected to the bottom 14, which means that it is injected to the pump housing 12 already during the manufacturing process. The trunnion 40 centrally extends into second opening 20.

A second gearwheel 42 is mounted onto the trunnion 40. The trunnion 40 engages into a central bearing opening 41 of the second gearwheel 42.

Both gearwheels 30 or 42 are respectively provided with a spiral toothing 44 and 46 and mesh each other. Such a spiral toothing is known from DE 197 25 462 A1 which is incorporated by reference.

The gearwheel 42 thus is the driven gearwheel.

The pump housing 12 is provided with a bayonet guide 48 on its outer side in the area of the lid 16.

The coupling pin 32 of the driving gearwheel 30 can be directly injected onto this gearwheel 30 and can consist either of a metallic material or of the plastic material the driven gearwheel 30 is made of.

The outer end of the coupling pin 32 is designed as a slit pin and is, thus, brought in connection by a slit coupling of the drive body when closing the bayonet connection. This design is described in DE 197 25 462 A1 to which reference is made.

The pump body 10 may be mounted onto a known drive body. The coupling is then done without further action.

Due to the trunnion 40 a guiding of the driven gearwheel 44 in operation is ensured in such a way that this gearwheel is not exposed to high wear by the difference pressure or the drive pressure, in particular because there is no intensive friction with the inner side of the pump housing 12 neither circumferentially neither with the front part thereof.

The pump body 10 can be designed as a disposable part, i.e. after one single use it needs not to be dismounted and cleaned, but can be thrown away. But it is also possible, if correspondingly resistant materials are selected, to dismount the pump body 10, to clean and to sterilize the single parts and to reassemble them to a pump body 10 illustrated in the drawing.

What is claimed is:

1. A medical gear pump for sucking and irrigating, comprising a pot-like pumping housing having a first and a second cylindrical opening overlapping one to another, said two openings are connected to an inlet and an outlet, respectively, said pot-like pump housing having a closed bottom at one side and an open end at an opposite side, a driving gearwheel arranged in said first opening, a driven gearwheel arranged in said second opening, said driving gearwheel and said driven gearwheel are meshing a single trunnion protruding from an inner side of said bottom of said pot-like pump housing and extending into said second opening, said driven gearwheel being mounted onto said trunnion, a lid for closing said open end of said pot-like pump-housing, said lid having a bore therein, and a coupling pin protruding from said driving gearwheel and extending through said bore in said, lid said pot-like pump housing and said lid having no protruding structure to support said driving gearwheel.

2. The pump of claim 1, wherein said trunnion is molded to said bottom of said pot-like pump housing.

3. The pump of claim 1, wherein said trunnion is conical.

4. A medical gear pump for sucking and irrigating, comprising a pot-like pump housing having a first and a second cylindrical opening overlapping one to another, said two openings are connected to an inlet and an outlet, respectively, said pot-like pump-housing having a closed bottom at one side and an open end at an opposite side, a driving gearwheel arranged in said first opening, a driven gearwheel arranged in said second opening, said driving gearwheel and said driven gearwheel are meshing, a conical trunnion protruding from an inner side of said bottom of said pot-like pump housing and extending into said second opening, said driven gearwheel being mounted onto said trunnion, and a lid for closing said open end of said pot-like pump-housing.

* * * * *